US006156391A

United States Patent [19]

Shum et al.

[11] Patent Number: 6,156,391

[45] Date of Patent: Dec. 5, 2000

[54] PROCESS FOR HARD FACING A METALLIC SUBSTRATE TO IMPROVE WEAR RESISTANCE

[75] Inventors: William Y. Shum, Hacienda Heights; Lynn C. Bailey, Chula Vista, both of Calif.

[73] Assignee: Rankin Industries, Inc., San Diego, Calif.

[21] Appl. No.: 09/332,398

[22] Filed: Jun. 14, 1999

[51] Int. Cl.[7] ..... C23C 4/06

[52] U.S. Cl. ..... 427/448; 427/449; 427/451; 427/456; 219/77; 219/146.23

[58] Field of Search ..... 427/449, 456, 427/448, 451; 219/77, 146.23

[56] References Cited

U.S. PATENT DOCUMENTS

| | | | |
|---|---|---|---|
| 4,741,974 | 5/1988 | Longo et al. | 428/558 |
| 5,879,743 | 3/1999 | Revankar | 427/191 |

*Primary Examiner*—Katherine A. Bareford
*Attorney, Agent, or Firm*—Edgar W. Averill, Jr.

[57] ABSTRACT

A method for hard facing a tool. The method is carried out by thermally spraying the tool with a composition which includes between 1½%–10% carbon, 0–3% fluorides, 1½–5% boron, 20–40% chromium, 1–15% nickel and the remainder iron. The resulting coated tool has exceptional wear resistance and bond strength, especially for ground engaging tools.

8 Claims, 1 Drawing Sheet

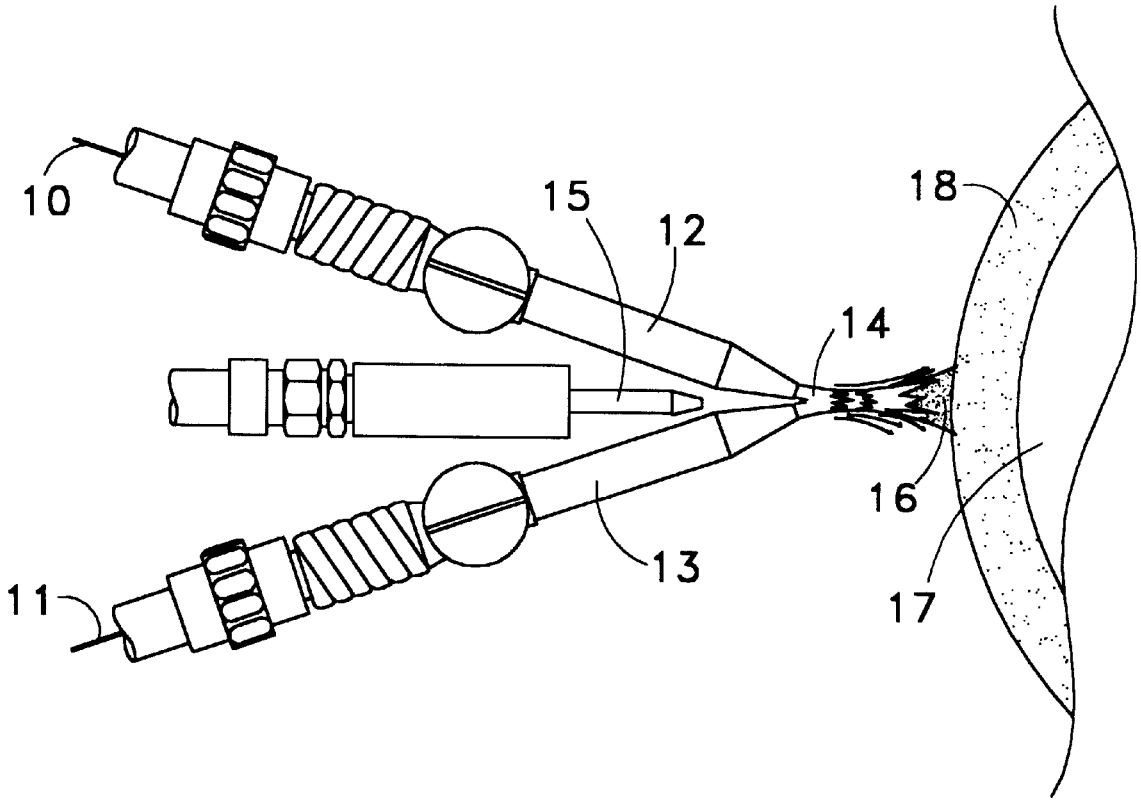
10
15
12
18
14
16
13
11
17

PROCESS FOR HARD FACING A METALLIC SUBSTRATE TO IMPROVE WEAR RESISTANCE

BACKGROUND OF THE INVENTION

The field of the invention is hard facing of tools and the invention relates more particularly to the hard facing of ground engaging tools to increase the life of such tools. Such tools include harrow discs, plow discs, plow shares, trencher teeth and the like. Various alloy compositions are set forth in the following patents: U.S. Pat. Nos. 3,029,165; 3,603,763; 4,741,974; 5,294,462; 5,332,628; and 5,695,825. The compositions in these patents generally have a very low amount of carbon. The compositions, when applied to ground engaging tools, requires not only wear resistance and hardness, but also a very high degree of bond strength.

Prior art alloys have lacked sufficient bond strength. Many tubular composite metal cored wires have been evaluated for hard facing of agricultural ground engaging tools with the twin arc spray process and the results have been disappointing, particularly relating to poor bonding. The poor bonding between the hard facing deposit and the ground engaging tool has been the leading cause of premature failures. To the date of the present invention, it is believed that no composition can be used without failures in the coating of ground engaging tools.

Various practices are used to place a hard facing on a ground engaging tool. These processes include the oxy-acetylene gas process. Ground engaging tools are preheated to 300–900° F., then the hard facing rod or wire is manually, semi-automatically or automatically melted by oxy-acetylene torch and deposited on the ground engaging tool.

Another process that has been used is the process sold under the trademark DURA FACE. Surface oxides are removed from the ground engaging tool and a hard facing paste or slurry is applied to the surface. The surface is permitted to dry or set and then the coated ground engaging tool is placed in a controlled atmosphere oven and the coating is sintered on the surface.

Another process is the spray fuse process. In this process ground engaging tools are heated to 700–1,000° F. Hard facing powders are sprayed on the heated ground engaging tool through a powder torch. Then the hard facing powder is fused on the ground engaging tool by the powder torch.

The poor bonding between the coating and the ground engaging tool has made such coatings fail to provide a long-lasting coated tool.

BRIEF SUMMARY OF THE INVENTION

The present invention is for a process for coating a ground engaging tool which will produce vastly improved bonding. It has been discovered that the relatively high amounts of fluorides, boron, carbon and chromium along with other suitable metallic ingredients in the core of a tubular composite metal-cored wire through the twin arc spray process will produce a low-melting molten metal and result in a well-bonded hard facing coating.

The present invention is for a method for hard facing a substrate which includes the steps of furnishing an article comprising a tubular composite wire whose net composition is, in weight percent, between 1½–10% carbon, 0–3% fluorides, 1½–5% boron, 20–40% chromium, 1–15% nickel, and the remainder iron. This composition is thermally applied to an article and provides a coating which has excellent bonding properties. Preferably, the coating has 2–5% carbon, 0.02–0.3% fluorides, 1½–3½% boron, 22–28% chromium, 2–5% nickel with the balance being iron.

It has also been discovered that by operating the twin arc spray process in such a way as to provide a granular or porous outer surface, the life of the ground engaging tool is further improved. It has also been discovered that a self-sharpening ground engaging tool such as a disc can be created by hard facing one of the surfaces and leaving the other surface uncoated. As the uncoated surface wears, the hard facing coating provides a sharp edge which maintains its sharpness even as it wears, since the uncoated surface always wears faster.

BRIEF DESCRIPTION OF THE DRAWINGS

The FIGURE shows an arc spray gun shown spraying an alloy by a thermal spray process on the face of a ground engaging tool.

DESCRIPTION OF THE PREFERRED EMBODIMENTS

Thermal spraying sprays a molten metallic or non-metallic substance onto a substrate to provide it with protection or improved properties. The surfacing material comes in the form of wire, rod, cord, or powder and is made molten by heat generated in the delivery device, namely a thermal spray gun. The surfacing material is propelled to the substrate in particle form, usually by an atomizing gas. It impacts on the substrate with sufficient force to create a bond with the substrate or with particles that have already been deposited. The particles conform to the shape of the substrate and then cool to form a coating.

In the process of arc spraying, two continuous consumable wires are used. The wires are automatically fed to a point in front of an atomizing nozzle. An arc is established between the two wires, melting them. The atomizing nozzle directs a stream of gas (often compressed air) into the melt zone, propelling the particles with force onto the substrate.

An arc spray setup consists of a DC power supply, a reel wire feeder, a spray gun, and a delivery system for compressed air. The power supply should be capable of delivering between 18–40 volts. Typically, the voltage should be kept as low as possible while retaining arc stability. The particle size will increase as the voltage increases.

An arc spray gun is shown in the drawing. The wires 10 and 11 are insulated from each other and are fed into contact tubes 12 and 13, and an arc 14 forms at the contact between charged wires 10 and 11. An atomizing nozzle 15 sprays air into the arc area, propelling molten particles 16 onto a substrate. Substrate 17 has been first cleaned of contaminants that will inhibit bonding and it should be roughened to create slight irregularities to promote a strong adhesion to the surface. The result is a coating 18 on a desired portion of substrate 17. Substrate 17 in the drawing is a portion of a harrow disc used in agriculture to break up the ground prior to planting.

While bond strength has been a cause of failure of prior sprayed coatings, it has been discovered that the use of relatively high amounts of boron, carbon, and chromium, along with other suitable metallic ingredients and a core of a tubular composite cored wire produces a low-melting molten metal which results in a well-bonded hard facing coating.

The composition is shown in the following table, both in a broad range and a preferred range.

Percent by Weight

| | Broad Range | Narrow Range |
|---|---|---|
| Carbon | 1.5–10.0 | 2–5 |
| Fluorides | 0–3.0 | 0.02–0.3 |
| Boron | 1.5–5.0 | 1.8–3.5 |
| Chromium | 20–40 | 22–28 |
| Nickel | 1–15 | 2–5 |
| Iron | Remainder | Remainder |

The above numbers refer to weight percent with regard to the entire wire. The wire is preferably a composite having an outer shell of iron which has been bent around, filled with a powdered mix of the desired alloys and turned over to seal the same and provide a cored wire with the above ranges of elements.

In the process of the present invention it is not necessary to heat the substrate prior to the spraying process nor is it necessary to subject the coated substrate with further treatment in an oven. By adjusting the voltage, a granular surface can be obtained which has been found to further improve wear as opposed to a completely smooth surface. While not wishing to be bound by any theory, it is believed that the granulated surface tends to hold dirt as the ground engaging tool passes through the ground and to cause a great deal of the work to be absorbed by particles held in the rough surface. The presence of up to 3% of fluoride tends to intensify the arc and thereby induces the viscosity and surface tension of the molten metal.

Another method has been discovered which tends to retain a ground engaging tool such as a disc in a perpetually sharp condition. Returning to the drawing, it can be seen that one side of the substrate which is a ground engaging harrow disc has been coated to the edge thereof. The other side has not been coated. Thus, when the harrow disc is used, the uncoated side of the cutting edge wears away faster than the coating. In this way, the edge, which is the coating, is always sharp which further facilitates the discing of a field by creating less resistance through the ground.

The result of the use of the process and materials of the present invention has been to provide ground engaging tools which have very high bond strength and which greatly increase the life of the use of the ground engaging tool.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A method for hard facing a substrate comprising the steps of:

furnishing an article comprising a tubular composite wire whose net composition is, in weight percent from about 1½ to about 10% carbon, about 1½ to about 5% boron, from about 20 to about 40 percent chromium, from about 1 to about 15% nickel, at least 0.02% and no more than 3% fluoride and the remainder iron; and thermally applying said article to a substrate as a coating.

2. The method of claim 1 wherein the amount of carbon is between about 2 and about 5%.

3. The method of claim 1 wherein the amount of boron is between about 1.8 and about 3.5%.

4. The method of claim 1 wherein the amount of chromium is between about 22 and about 28%.

5. The method of claim 1 wherein the amount of nickel is between about 2 and about 5%.

6. The method of claim 1 wherein said thermally applying step is a twin arc spray process with its voltage adjusted to provide a granular outer surface.

7. A process for producing a long-wearing, self-sharpening ground engaging tool comprising the steps of:

spraying a coated side of a cutting edge which has a coated side and an uncoated side by a twin arc spray process using tubular composite metal, cored wire whose net composition is, in weight percent from about 1½ to about 10% carbon, about 1½ to about 5% boron, from about 20 to about 40 percent chromium, from about 1 to about 15% nickel, from about 0.02% to about 0.3% fluoride, and the remainder iron, leaving the uncoated side unsprayed by the above composition.

8. The process of claim 7 wherein said coated side is grit blasted before said spraying step.

* * * * *